US006122770A

United States Patent [19]

Mathison et al.

[11] Patent Number: 6,122,770

[45] Date of Patent: Sep. 26, 2000

[54] ICE CLAW

[76] Inventors: Matthew B. Mathison, Rte. 1, Box 229, Lamberton, Minn. 56152; Michael D. Trost, 779 Main St., Rte. 2, Box 2F, Wabasso, Minn. 56293

[21] Appl. No.: 09/376,479

[22] Filed: Aug. 18, 1999

Related U.S. Application Data

[60] Provisional application No. 60/097,143, Aug. 19, 1998.

[51] Int. Cl.[7] ..... B63C 9/32

[52] U.S. Cl. ..... 2/20; 30/164.5; 224/232; 294/25; 441/82

[58] Field of Search ..... 2/20, 160, 161.1, 2/161.2, 161.6, 17; 30/164.5, 164.6, 164.7, 136; 224/232; 248/216.1, 925; 294/25; 441/80, 82

[56] References Cited

U.S. PATENT DOCUMENTS

| | | | |
|---|---|---|---|
| 18,607 | 11/1857 | Shaw | 2/20 |
| 118,790 | 9/1871 | Cadwell | 2/20 |
| 259,683 | 6/1882 | Hagen | 2/20 |
| 1,181,681 | 5/1916 | Nicaud | 30/164.4 |
| 1,369,326 | 2/1921 | Cottman | 2/20 |
| 1,705,205 | 3/1929 | Reams | 30/164.5 |
| 3,130,884 | 4/1964 | Lintz | 30/164.5 |
| 4,002,366 | 1/1977 | Hammes | 294/26 |
| 4,815,997 | 3/1989 | Forsmark et al. | 441/82 |
| 4,865,571 | 9/1989 | Caramanica et al. | 440/101 |
| 5,209,685 | 5/1993 | Hammes | 441/82 |
| 5,310,229 | 5/1994 | Hanson | 294/26 |
| 5,806,091 | 9/1998 | McHugh | 2/20 |
| 5,924,752 | 7/1999 | Moody | 294/25 |

FOREIGN PATENT DOCUMENTS

| | | | |
|---|---|---|---|
| 473364 | 5/1951 | Canada | 2/17 |

*Primary Examiner*—John J. Calvert
*Assistant Examiner*—Tejash Patel
*Attorney, Agent, or Firm*—Haugen Law Firm PLLP

[57] ABSTRACT

A retractable/extensible spike normally mounted in retractable disposition for slidable advance motion from within a protective sleeve-like retainer and held within a glove or other hand-engaging arrangement so that the tip of the spike may be extended outwardly to enable the user to obtain a grip on a slippery surface. The device is particularly useful as protection for individuals who may be engaging in wintertime activities on a frozen lake surface or frozen slope, particularly when there is a risk or danger of either falling through the ice into the frigid water, or falling from a slippery slope.

2 Claims, 7 Drawing Sheets

ICE CLAW

CROSS-REFERENCE TO RELATED APPLICATIONS

The subject matter of the present invention was filed by Matthew B. Mathison under the Document Disclosure Program, No. 414,938, filed Feb. 28, 1997, and entitled "LIFESAVING ICE CLAW GLOVE".

The present invention relates to Provisional Application Ser. No. 60/097,143, filed Aug. 19, 1998, by Matthew B. Mathison and Michael D. Trost, entitled "ICE CLAW".

BACKGROUND OF THE INVENTION

The present invention relates generally to a retractable spike or the like which is normally mounted for slidable movement within a protective sleeve-like retainer, and wherein the tip of the spike may be extended outwardly of the sleeve when needed to assist the user in gaining assistance in self-extrication from a hole in the ice or in moving onto or across the surface of wet and/or slippery ice. The device is particularly useful as protection for individuals who may be engaging in wintertime activities on a frozen lake surface, and when there is any risk or danger of falling through the ice into the frigid water.

During the Winter, activities are undertaken for work and/or pleasure which may require that a person venture onto or traverse a frozen lake or other body of water. During the early portions of each Winter, and also during the Spring, the ice which forms on the surface of the lake may be thin, broken, or otherwise unable to support the weight of a person, automobile, or other motor vehicle. As a result, individuals fall through the ice and the body's exposure to water at substantially 32° F. results in the rapid onset of hypothermia. In the event the person is in trouble, and if alone or otherwise unable to receive help, the person's life is in jeopardy, since it may be impossible for him or her to crawl out of the opening in the ice onto the surface of wet slippery ice adjacent the opening. Frequently, a modest additional amount of friction will enable a person to crawl out of the ice and survive the ordeal without succumbing to the onset of hypothermia and/or exposure.

It is extremely difficult for individuals to carry and/or travel across a frozen lake while carrying an article or device which would support them in the event the ice were to break. In this connection, long sticks, lumber, or the like are sometimes carried by people as a means of gaining assistance in creating a temporary anchor point for assistance in crawling out of holes in the ice, since sturdy boards and/or sticks tend to create friction and spread the load across a wider area of the ice, thus permitting the person to extricate himself before expiring due to hypothermia and/or exposure. However, because of the inconvenience of carrying such devices and for other considerations, a significant number of individuals do fall through the ice and due to difficulty in extricating themselves in sufficient time, they become victims.

SUMMARY OF THE INVENTION

In accordance with the present invention, an open-ended sleeve of flexible material is formed as a receptacle or retainer for slidably receiving a metal spike, whereby the tip or point of the spike can be extended outwardly in order to engage the surface of the ice in the event of falling through. In addition to the sleeve, a secondary finger-engaging loop is provided which will enable the spike retaining sleeve to be held in place in the palm of the wearer without interfering with many of the normal hand functions, and with a wider web of flexible loop material being provided and which may be attached to the elastic band in order to assist in retaining the spike retaining sleeve in place. In other words, the sleeve is held in the palm of the user's hand, the web of flexible elastic material is wrapped around the back of the hand, while the braided loop or cord is wrapped around the fingers to stabilize and/or retain the device in place in the palm. As designed, the device is suitable for use either over the hands, or also over gloves including bulky Winter gloves frequently required in the Winter. In this connection, the dimensions of the web of flexible material and the elastic loop are such that the band and web may be utilized to engage one or more fingers, up to three for stability and retention.

The device is preferably in the form of a casing of flexible material which is formed as a sleeve, and with the sleeve device being in generally cylindrical form. The casing, when formed in a cylindrical sleeve, is hollow, and a spike is slidably received within the sleeve so that the tip can be exposed or extended outwardly to assist the person in creating an anchor point and gaining purchase particularly for self-extrication from a frozen body of water.

The hollow center of the sleeve is a spike receiving cavity or zone in which a spike of conventional design is slidably received. In normal wearing of the device, the spike is held in retracted disposition, enclosed within the enclosure formed by the cylindrical shaped sleeve. If it becomes necessary to use the spike, the spike can be extended outwardly of the cylindrical portion by thumb pressure, whereupon the spike will be extended from the edge of the wearer's hand for engagement with the surface of ice or other slippery surface.

In addition to finding use in connection with extricating one's self from a hole in the ice, the device may also be employed as an aid in climbing or otherwise moving along an icy surface. One such example would be traversing or crawling across a frozen stream and/or waterfall where ice-climbing becomes necessary or essential. The device is employed in substantially the same fashion in these instances, as has been described hereinabove.

The device is advantageous in that it may be unrestrictably worn by the individual, by merely holding within the palm of one's hand. Additionally, it may be easily pressed into use by applying thumb pressure to the head of the spike, and thereby driving the tip outwardly of the receptacle and in an ice-engaging position.

It is a primary object of the present invention to provide an improved assembly for assisting a person in distress on a frozen lake or the like wherein the device employs a sharp nail or spike end to engage the ice surface, and the person may thereupon resort to self-help in pulling himself from the frozen body of water.

It is a further object of the present invention to provide an improved device and assembly for assisting a person in self-extrication from a hole in the ice, thereby providing a lifesaving service in emergencies.

It is still a further object of the present invention to provide an improved assembly which comprises a spike and a sleeve retainer, and wherein the spike may be subjected to thumb pressure to move the tip outwardly of the receptacle for use in assisting an individual in traversing frozen or slippery surfaces.

Other and further objects of the present invention will become apparent to those skilled in the art upon a study of the following specification and drawings.

IN THE DRAWINGS

DESCRIPTION OF THE PREFERRED EMBODIMENT

Figure 1:
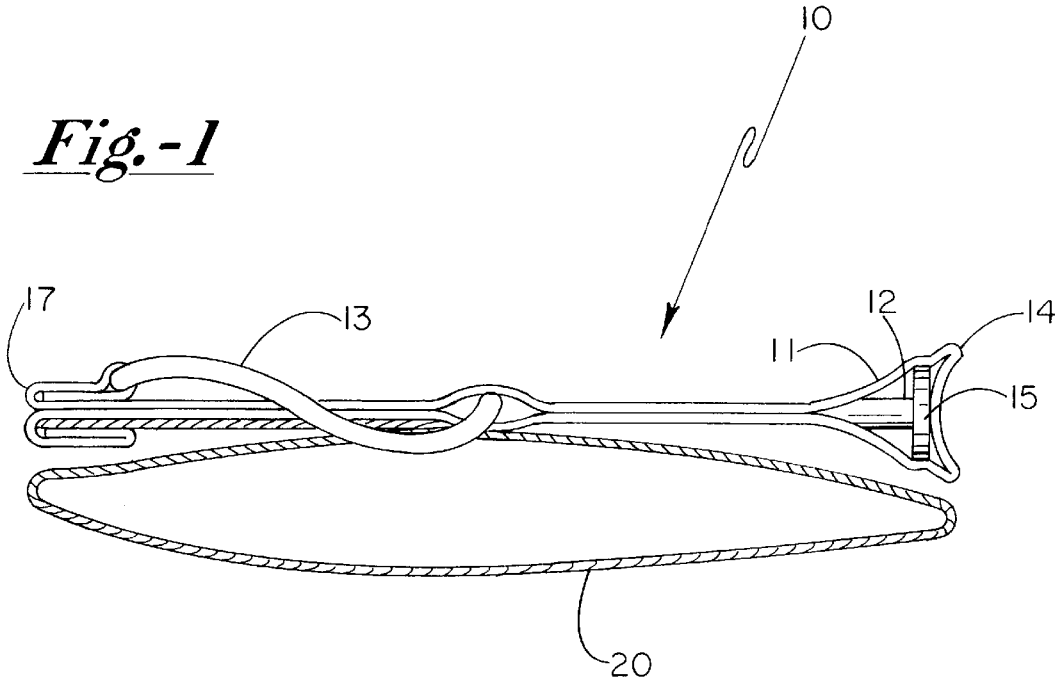
FIG. 1 is a top plan view of a device prepared in accordance with the present invention.

In accordance with the preferred embodiment of the present invention and with particular attention being directed to FIG. 1 of the drawings, the assembly 10 comprises a hollow sleeve 11 enclosing a spike 12 therewithin, and further comprising an elastic web or band 13 which is coupled to spaced portions of the sleeve 11. The spike is slidably received within the confines of the sleeve, with the head portion 14 being positioned adjacent the closed end 15 of sleeve 11. The opposed end of sleeve 11, such as at 17, is open and thus permitting the tip of the spike 18 to be forced outwardly by modest thumb pressure against head 14.

Figure 3:
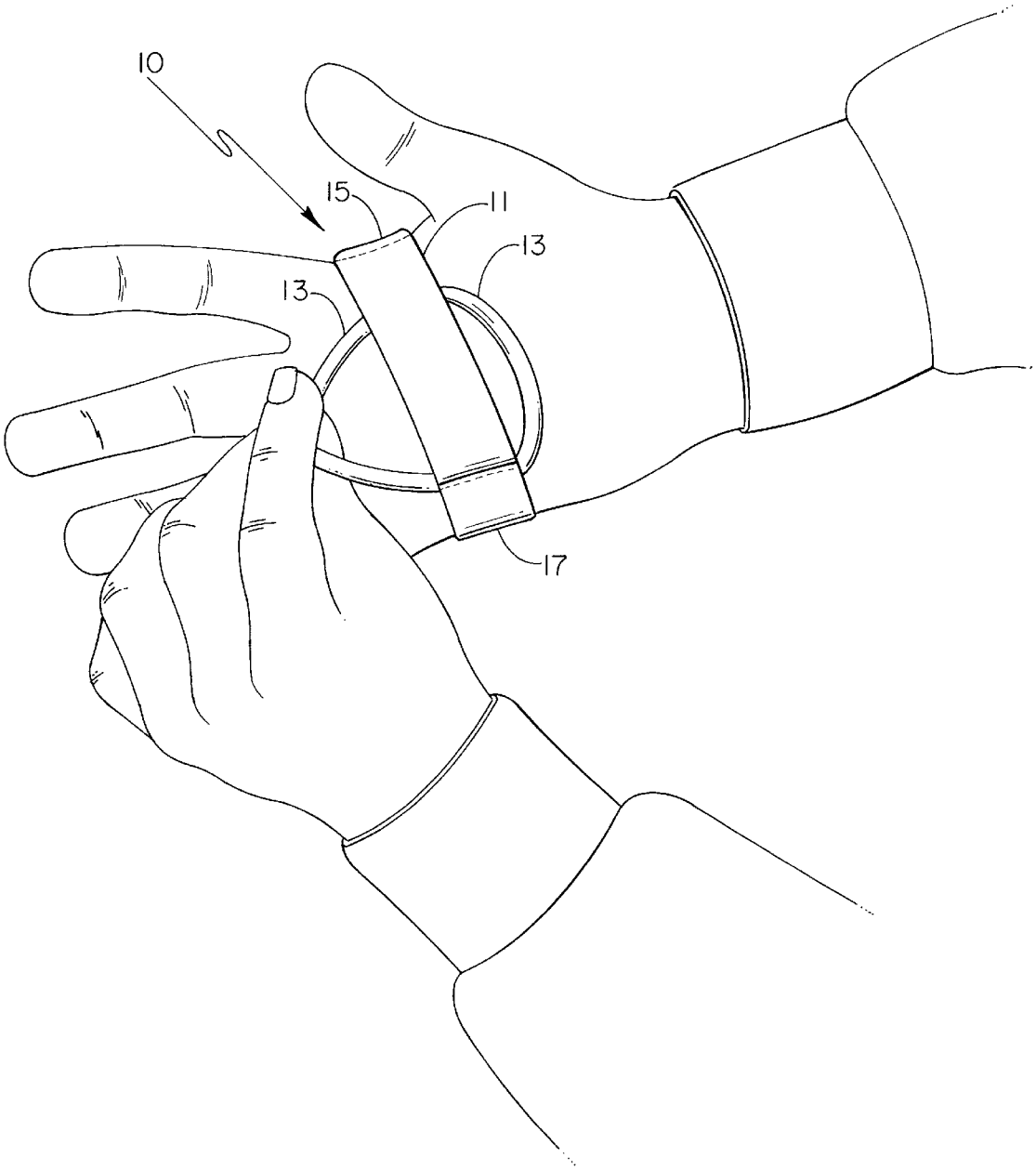
FIG. 3 is a perspective view illustrating the device being in place on an individual's hand.
Figure 4:
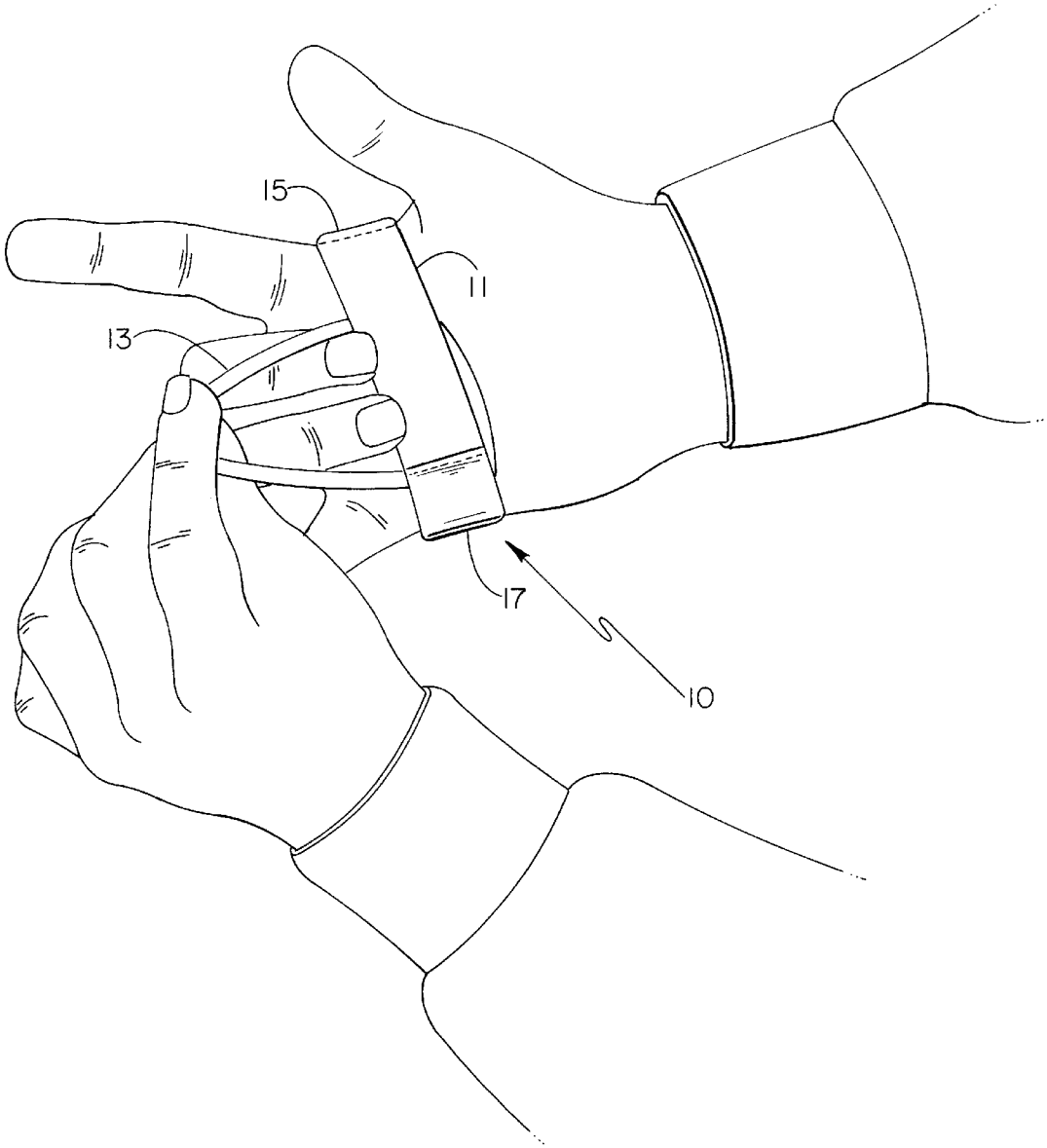
FIG. 4 is a view similar to FIG. 3 and illustrating the device in a further step of mounting in the hand.
Figure 5:
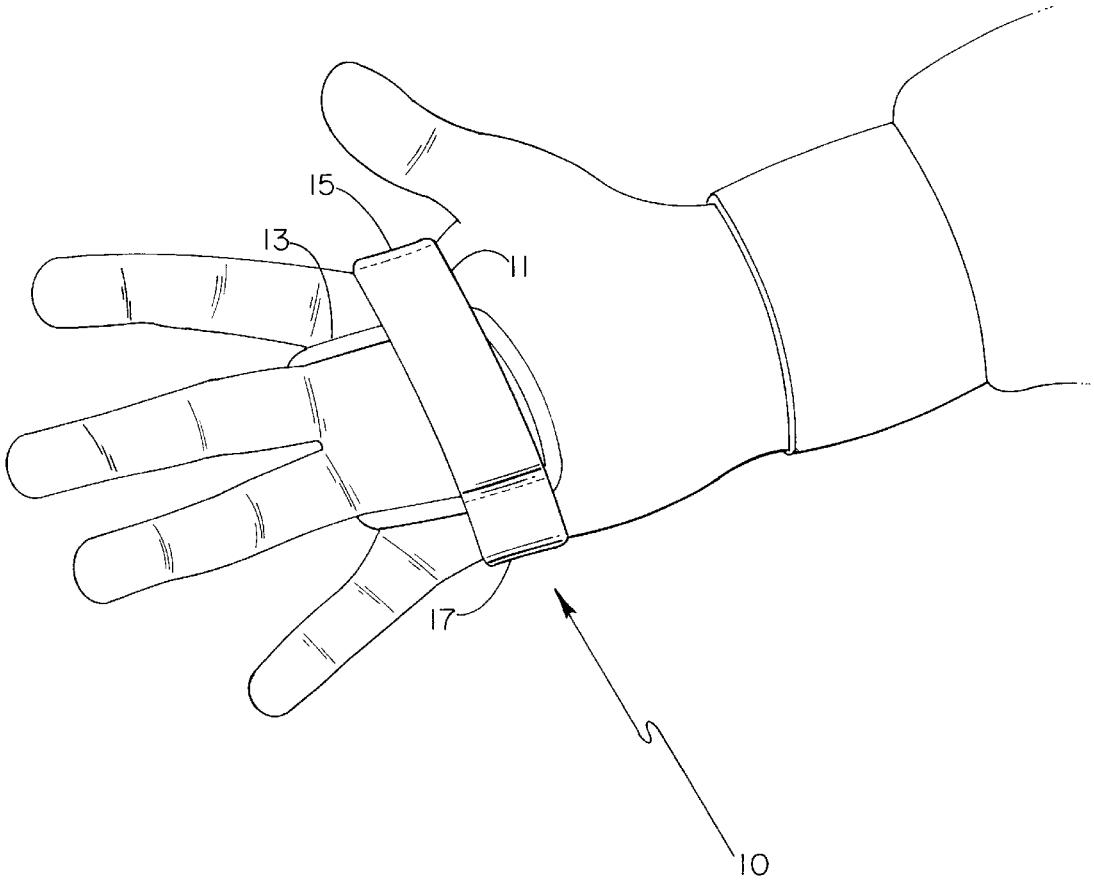
FIG. 5 is a view similar to FIG. 3 showing the device engaged in a wearer's hand and held in place in the palm and stabilized with the elastic band and webbing extending over two fingers.
Figure 6:
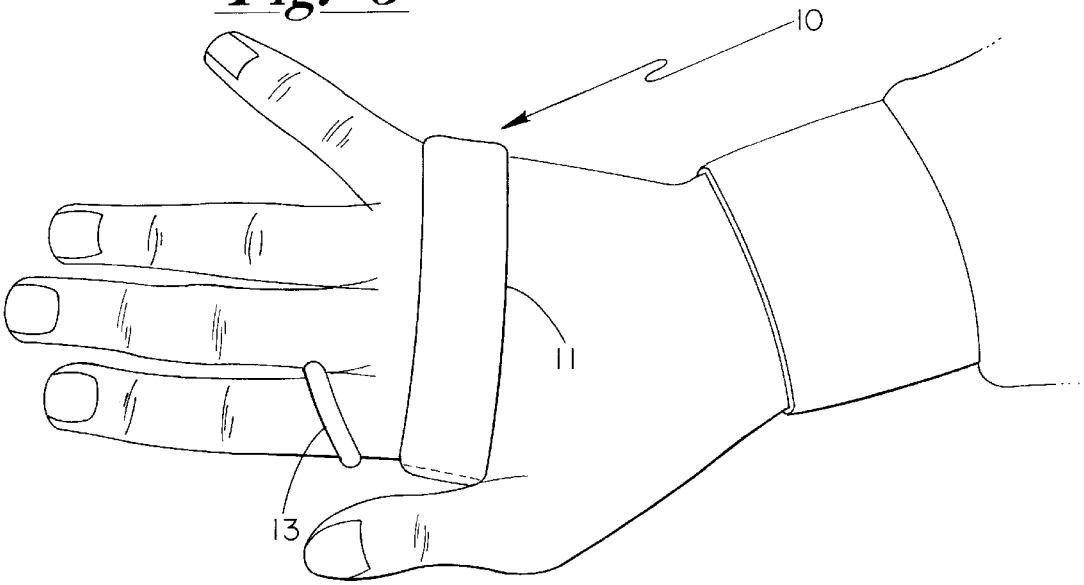
FIG. 6 is a view similar to FIG. 5 showing the device in use, with the loop and web being engaged on one finger of a wearer.
Figure 7:
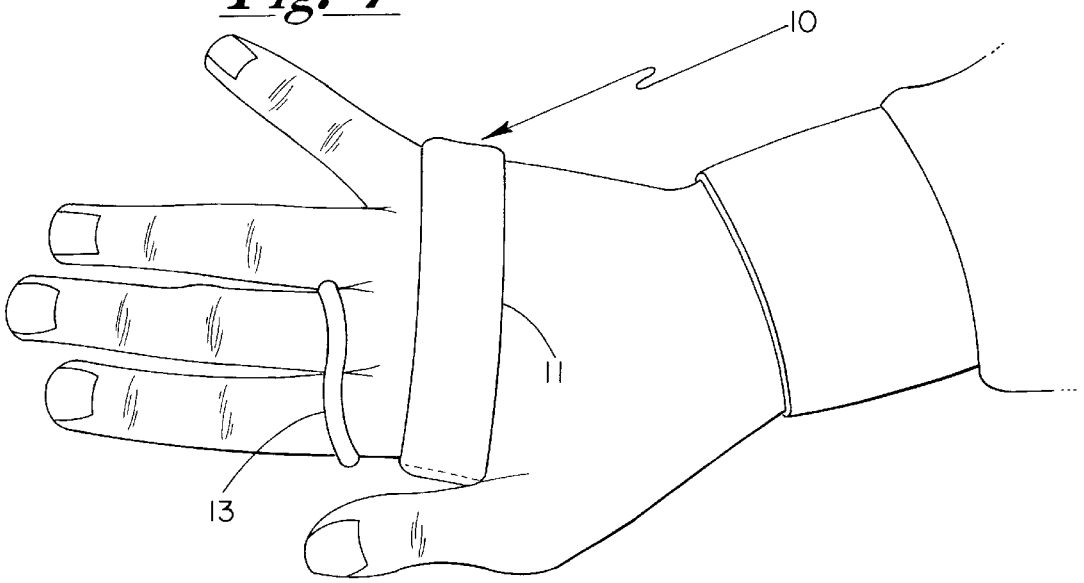
FIG. 7 is a still further view showing the device on the rear side or surface from the back of the hand.
Figure 8:
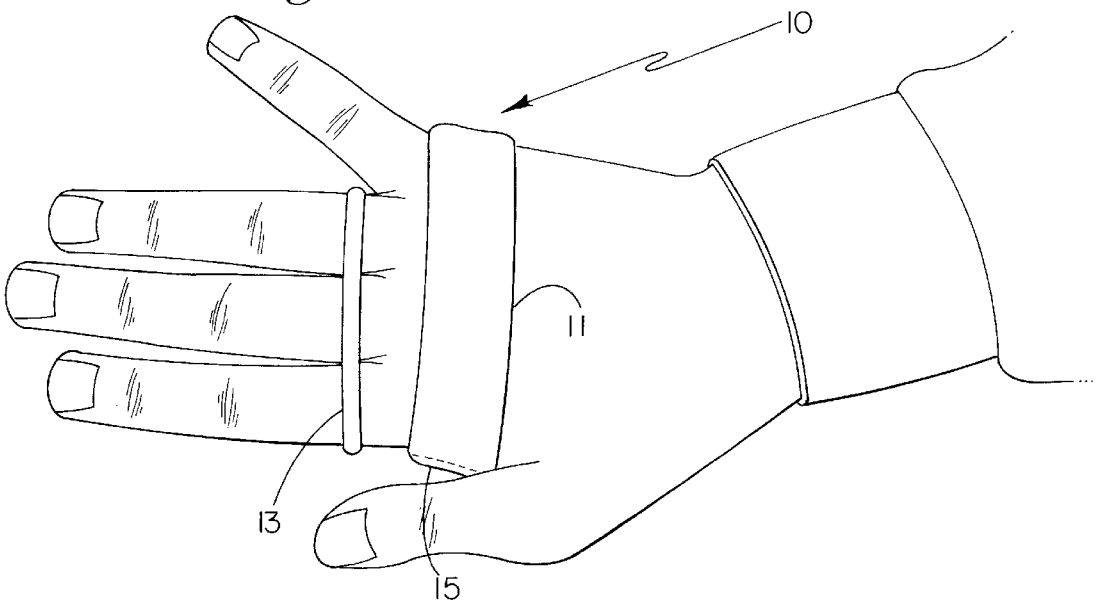
FIG. 8 is a view similar to FIG. 7 showing the back of a wearer's hand wherein the loop and web portions of the device are engaged with three fingers.
Figure 9:
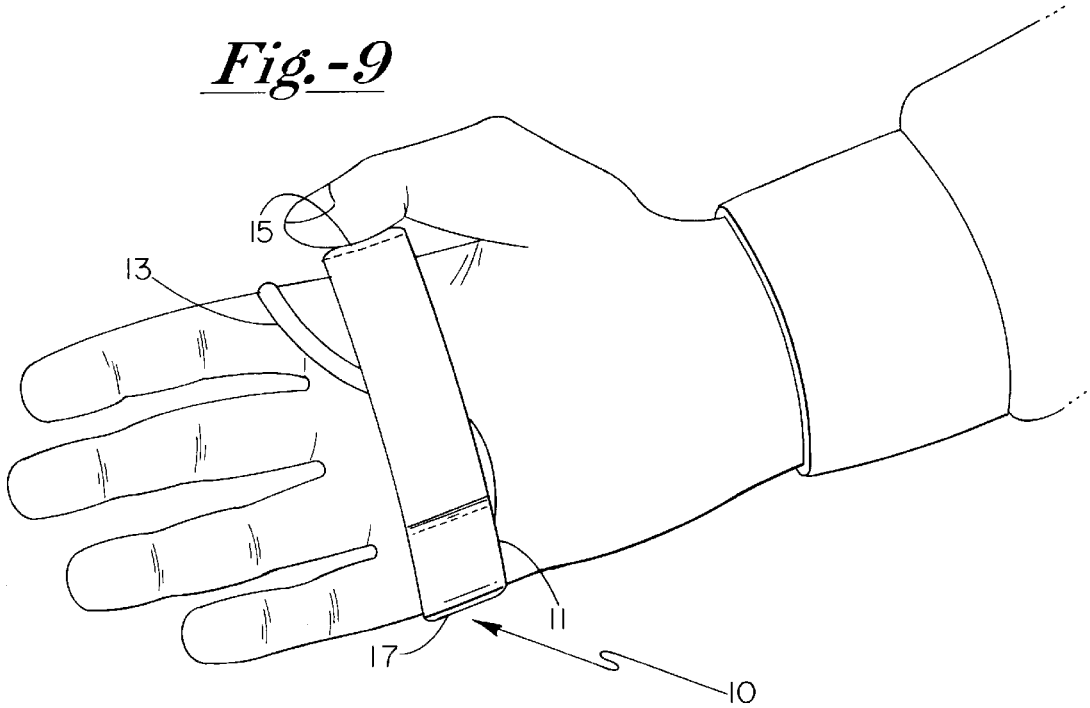
FIG. 9 is a view similar to FIG. 8 showing the back of a wearer's hand wherein the device is engaged with three fingers, illustrating the manner in which the assembly is rendered resistant to rotation in order to permit the extension of the spike.
Figure 10:
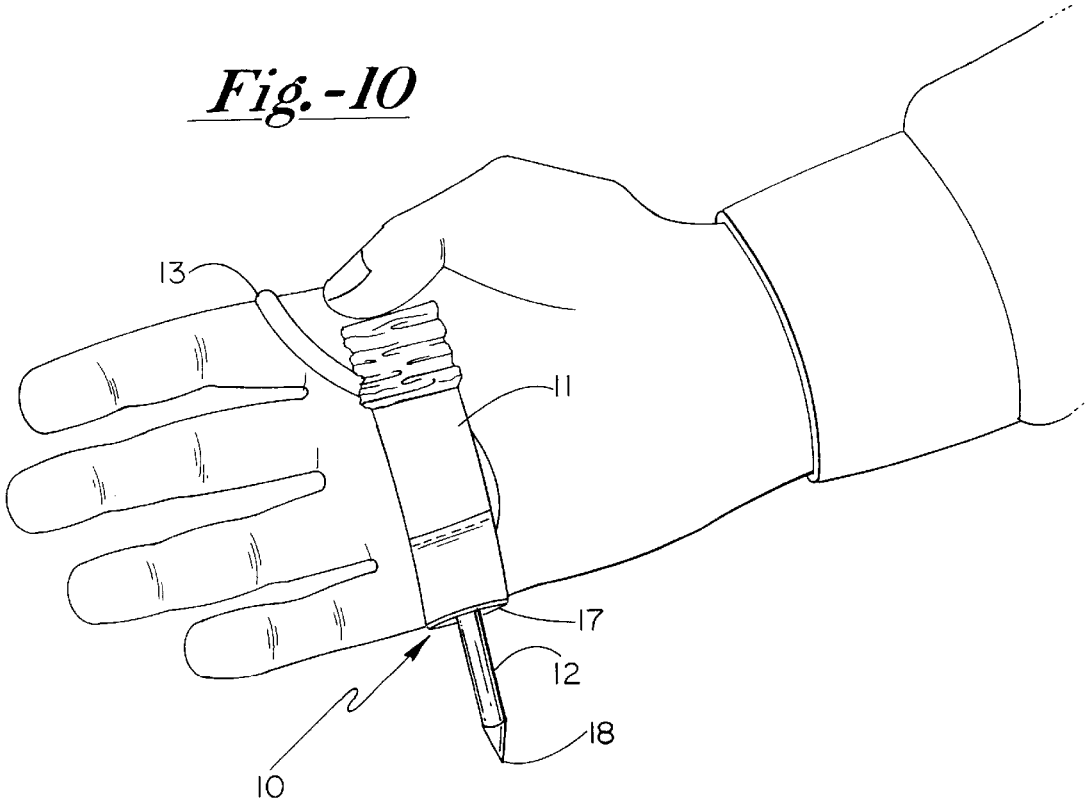
FIG. 10 shows the device depressed at the head end by the thumb, with the spike extended and ready for use.
Figure 11:
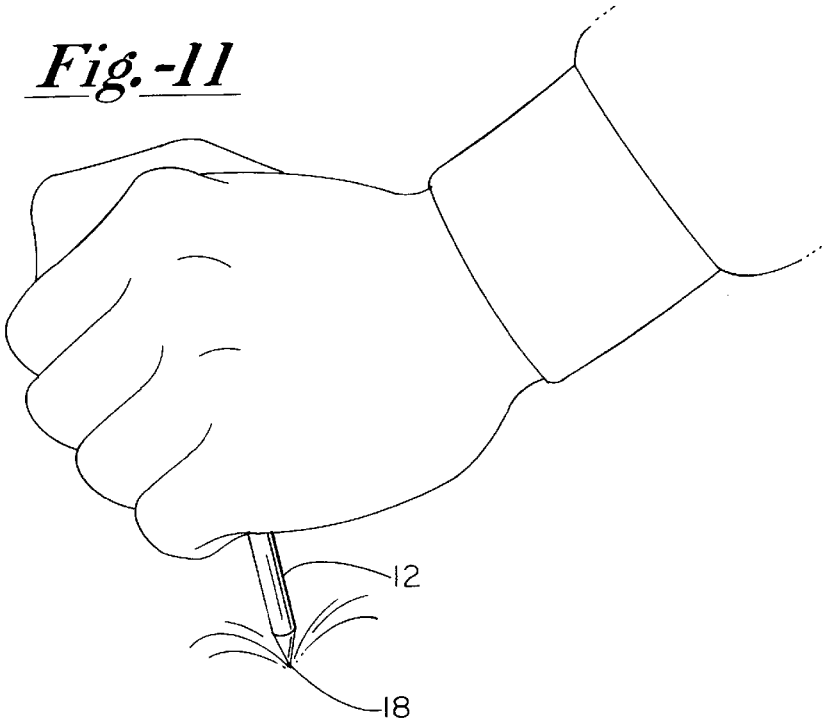
FIG. 11 shows the device in use with the hand being formed in a fist around the thumb to drive the spike into the ice.

Band 13 is designed to fit around the fingers of the user, such as is apparent in the utilization drawings set forth in FIGS. 3–11 inclusive. In particular, band 13 may simply be placed across the back of one's fingers, as indicated in FIGS. 3 and 4, or over the finger portions of a glove as indicated in the showing of FIGS. 7 and 8. As an alternative, the device may be sewn into the palm of a glove, however it generally has been found more desirable and universally adaptable for the device to be assembled with the web and elastic band being employed for retention and stability.

As a suitable material of construction, sleeve 11 may be fabricated from Type IV webbing, and band 13 may be formed of an elastic material, while cord 20 may be a braided cord and adjustable for use on either right or left hands. Additionally, a wide elastic band may be employed. As illustrated, the elastic band is in the form of a oneinch band illustrated in phantom in order to show the two items separately in view of the difference in texture.

Figure 2:
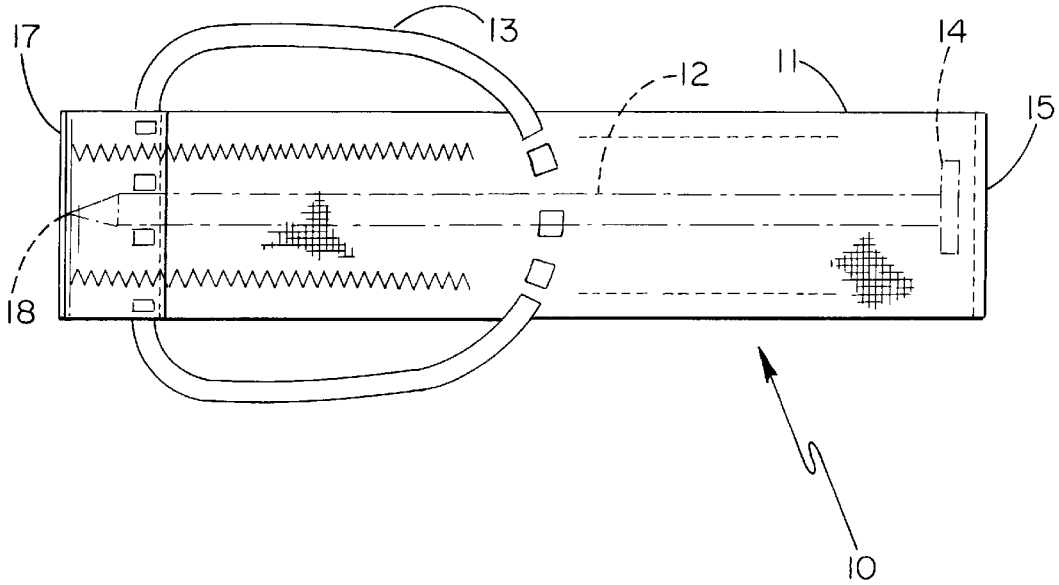
FIG. 2 is a side elevational view of the assembly of FIG. 1.

In order to permit ease in pushing the spike outwardly from the sleeve 11, stitching may be provided at a distance of approximately 1/16th inch from the edge in order to create a lip which aids in pushing the spike outwardly. Such an arrangement is illustrated in FIG. 2.

The spike 12 may be in the form of a spike such as a 20*d* box nail, or larger. In order to assist in manipulation of the spike when needed, the surface may be advantageously coated with a film of material such as polytetrafluoroethylene (Teflon), silicone, or the like. Alternatively, the surface of spike 12 may be coated with a deposit of a metal such as chromium, wax, or the like which assists in providing a lower friction surface. The material forming sleeve 11 is preferably provided with a water resistant coating in order to prevent the spike from becoming frozen in place following exposure to water. As an alternative to coating of the sleeve material, it may be fabricated of a laminated material with a water resistant coating.

In such an instance, the webbing utilized for sleeve 11 may be one-inch Type IV webbing, with alternatively the elastic band shown at 13 having a width of one-inch as well.

What is claimed is:

1. Hand held gripping means including an extensible spike for engaging a slippery surface to assist the wearer in using arm force to traverse slippery surfaces and aid in extricating himself, and comprising, in combination:

(a) a sleeve portion comprising an endless loop with a palm side and a back side for fully encircling a hand and a finger engaging loop attached to an inner side of the palm side thereof;

(b) said finger engaging loop including an endless loop having proximal and distal segmental portions with each segmental portion being adapted to extend from said palm surface and over one or more fingers so as to be in proximal and distal encircling engagement respectively with said fingers;

(c) a cylindrical spike and a cylindrical sleeve secured to an outer surface of said palm side and slidably enclosing said spike therewithin;

(d) said cylindrical spike having a body with a central shank and a head at one end and a pointed tip at the opposed end;

(e) the spike being in slidable engagement with the cylindrical sleeve and adapted to advance with passage from a thumb or finger.

2. The hand held gripping means as defined in claim 1 being particularly characterized in that said sleeve comprises an elastic web.

* * * * *